US007581337B2

(12) United States Patent
Miller et al.

(10) Patent No.: US 7,581,337 B2
(45) **Date of Patent: *Sep. 1, 2009**

(54) EXPANDABLE SHOE HAVING SCREW DRIVE ASSEMBLIES

(75) Inventors: Harry Miller, Weston, MA (US); Byong M. Shin, Busan (KR); Kwong Dong Chil, Pusan (KR)

(73) Assignee: Inchworm, Inc., Boston, MA (US)

( * ) Notice: Subject to any disclaimer, the term of this patent is extended or adjusted under 35 U.S.C. 154(b) by 416 days.

This patent is subject to a terminal disclaimer.

(21) Appl. No.: 10/875,973

(22) Filed: Jun. 24, 2004

(65) Prior Publication Data

US 2005/0055848 A1 Mar. 17, 2005

Related U.S. Application Data

(60) Continuation-in-part of application No. 10/191,682, filed on Jul. 9, 2002, now Pat. No. 6,817,116, which is a division of application No. 09/438,935, filed on Nov. 12, 1999, now Pat. No. 6,438,872.

(51) Int. Cl.
*A43B 3/26* (2006.01)
*A43B 1/10* (2006.01)
*A43D 1/00* (2006.01)

(52) U.S. Cl. ..... 36/97; 36/102; 36/8.4

(58) Field of Classification Search ..... 36/88, 36/93, 97, 102, 112, 8.4
See application file for complete search history.

(56) References Cited

U.S. PATENT DOCUMENTS 4,497 A 5/1846 Vetter
524,946 A 8/1894 Kregel
526,626 A 9/1894 Kregel
797,966 A 8/1905 Lange et al.
831,210 A 9/1906 Bosley
955,337 A 4/1910 Lawlor
1,539,762 A 5/1925 Mussabini
1,633,413 A 6/1927 Marca
1,821,051 A * 9/1931 Brown ..... 36/8.4
1,856,377 A 5/1932 Dettelbach
2,009,684 A 7/1935 Affronte
2,112,052 A 3/1938 Smith (Continued)

FOREIGN PATENT DOCUMENTS

CA 2201816 10/1998

(Continued)

*Primary Examiner*—Jila M Mohandesi
(74) *Attorney, Agent, or Firm*—Black Lowe & Graham PLLC

(57) ABSTRACT

An expandable shoe includes an outer shell and an adjustable inner assembly within the outer shell. The inner assembly includes a first sole portion, a second sole portion, and a screw drive. The screw drive has a screw passing through a screw insert mounted to one of the first and second sole portions and a screw-receiving portion attached to the other of the first and second sole portions, so that turning the screw causes the sole portions to move relative to one another, thereby adjusting a dimension of the shoe. The shoe includes a manually operable control to turn the screw without the need for tools. The control is operable between a first position in which the control resists movement around an axis defined by the screw and a second position in which the control can be used to turn the screw to adjust a dimension of the footwear.

22 Claims, 9 Drawing Sheets

U.S. PATENT DOCUMENTS

| | | | |
|---|---|---|---|
| 2,113,898 | A | 4/1938 | Nehus |
| 2,295,364 | A | 9/1942 | Skorepa |
| 2,497,175 | A | 2/1950 | Mantos |
| 2,603,889 | A | 7/1952 | Lahnstein et al. |
| 2,734,284 | A | 2/1956 | Seurbom |
| 2,825,109 | A | 3/1958 | Nelson |
| 3,008,250 | A | 11/1961 | Herunter |
| 3,057,085 | A | 10/1962 | Rigsby |
| 3,389,481 | A | 6/1968 | England |
| 3,431,658 | A | 3/1969 | Finn |
| 3,436,842 | A | 4/1969 | Sachs |
| 3,541,708 | A | 11/1970 | Rosen |
| 3,618,235 | A | 11/1971 | Cary, Jr. |
| 3,668,791 | A | 6/1972 | Salzman et al. |
| 3,686,777 | A | 8/1972 | Rosen |
| 3,738,027 | A | 6/1973 | Schoch |
| 3,748,756 | A | 7/1973 | White |
| 3,771,529 | A | 11/1973 | Matteson |
| 3,794,037 | A | 2/1974 | Matteson |
| 3,808,644 | A | 5/1974 | Schoch |
| 3,834,048 | A | 9/1974 | Maurer |
| 3,883,964 | A | 5/1975 | Check |
| 3,992,800 | A | 12/1975 | Miller et al. |
| 3,965,544 | A | 6/1976 | Boden |
| 3,997,985 | A | 12/1976 | Shiina |
| 4,060,918 | A | 12/1977 | Mandel |
| 4,083,128 | A | 4/1978 | Rossman |
| 4,120,103 | A | 10/1978 | Colby |
| 4,136,468 | A | 1/1979 | Munschy |
| 4,166,329 | A | 9/1979 | Herbig |
| 4,178,925 | A | 12/1979 | Hirt |
| 4,192,087 | A | 3/1980 | Salomon |
| 4,299,039 | A | 11/1981 | Hanson |
| 4,360,979 | A | 11/1982 | Spademan |
| 4,379,370 | A | 4/1983 | Balbinot |
| 4,426,796 | A | 1/1984 | Spademan |
| 4,433,456 | A | 2/1984 | Baggio |
| 4,510,704 | A | 4/1985 | Johnson |
| 4,523,395 | A | 6/1985 | Borsoi |
| 4,551,932 | A | 11/1985 | Schoch |
| 4,553,342 | A | 11/1985 | Derderian et al. |
| 4,615,127 | A | 10/1986 | Delery |
| 4,616,524 | A | 10/1986 | Bidoia |
| 4,619,058 | A | 10/1986 | Gumbert |
| 4,633,599 | A | 1/1987 | Morell et al. |
| 4,653,204 | A | 3/1987 | Morell et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,731,940 | A | 3/1988 | Zanatta et al. |
| 4,748,726 | A | 6/1988 | Schoch |
| 4,754,560 | A | 7/1988 | Nerrinck |
| 4,765,070 | A | 8/1988 | Chemello et al. |
| 4,799,297 | A | 1/1989 | Baggio et al. |
| 4,841,649 | A | 6/1989 | Baggio et al. |
| 4,858,341 | A | 8/1989 | Rosen |
| 4,884,760 | A | 12/1989 | Baggio et al. |
| 4,907,354 | A | 3/1990 | Benoit et al. |
| 4,931,773 | A | 6/1990 | Rosen |
| 4,937,952 | A | 7/1990 | Olivieri |
| 4,937,953 | A | 7/1990 | Walkhoff |
| 4,942,678 | A | 7/1990 | Gumbert |
| 4,944,099 | A | 7/1990 | Davis |
| 4,949,479 | A | 8/1990 | Ottieri |
| 4,961,544 | A | 10/1990 | Bidoia |
| 4,967,492 | A | 11/1990 | Rosen |
| 4,969,277 | A | 11/1990 | Williams |
| 4,998,358 | A | 3/1991 | Girardelli |
| 5,036,604 | A | 8/1991 | Rosen |
| 5,042,177 | A | 8/1991 | Schoch |
| 5,060,402 | A | 10/1991 | Rosen |
| 5,062,224 | A | 11/1991 | Tacchetto |
| 5,079,858 | A | 1/1992 | Sartor et al. |
| 5,113,599 | A | 5/1992 | Cohen et al. |
| 5,117,567 | A | 6/1992 | Berger |
| 5,157,813 | A | 10/1992 | Carroll |
| 5,158,767 | A | 10/1992 | Cohen et al. |
| 5,177,882 | A | 1/1993 | Berger |
| 5,181,331 | A | 1/1993 | Berger |
| 5,205,055 | A | 4/1993 | Harrell |
| 5,224,280 | A | 7/1993 | Preman et al. |
| 5,241,762 | A | 9/1993 | Rosen |
| 5,265,349 | A | 11/1993 | Munschy |
| 5,285,584 | A | 2/1994 | Dubner |
| 5,291,671 | A | 3/1994 | Caberlotto et al. |
| 5,319,868 | A | 6/1994 | Hallenbeck |
| 5,325,613 | A | 7/1994 | Sussmann |
| 5,325,614 | A | 7/1994 | Rosen |
| 5,327,662 | A | 7/1994 | Hallenbeck |
| 5,333,398 | A | 8/1994 | Seo |
| 5,341,583 | A | 8/1994 | Hallenbeck |
| 5,345,697 | A | 9/1994 | Queltais |
| 5,351,710 | A | 10/1994 | Phillips |
| 5,355,596 | A | 10/1994 | Sussmann |
| 5,381,609 | A | 1/1995 | Hieblinger |
| 5,384,970 | A | 1/1995 | Melton |
| 5,404,658 | A | 4/1995 | Rosen |
| 5,408,761 | A | 4/1995 | Gazzano |
| 5,437,110 | A | 8/1995 | Goldston et al. |
| 5,459,949 | A | 10/1995 | MacPhail |
| 5,467,537 | A | 11/1995 | Aveni et al. |
| 5,502,902 | A | 4/1996 | Sussmann |
| 5,511,325 | A | 4/1996 | Hieblinger |
| 5,570,523 | A | 11/1996 | Lin |
| 5,599,088 | A | 2/1997 | Chien |
| 5,600,874 | A | 2/1997 | Jungkind |
| 5,657,557 | A | 8/1997 | Hull et al. |
| 5,659,980 | A | 8/1997 | Lin |
| 5,678,325 | A | 10/1997 | Davidowitz et al. |
| 5,682,687 | A | 11/1997 | Arai |
| 5,699,629 | A | 12/1997 | Munschy |
| 5,709,954 | A | 1/1998 | Lyden et al. |
| 5,729,912 | A | 3/1998 | Gutkowski et al. |
| 5,737,854 | A | 4/1998 | Sussmann |
| 5,791,021 | A | 8/1998 | James |
| 5,791,068 | A | 8/1998 | Bernier et al. |
| 5,794,362 | A | 8/1998 | Polk, III et al. |
| 5,809,620 | A | 9/1998 | Crowley et al. |
| 5,813,146 | A | 9/1998 | Gutkowski et al. |
| 6,045,144 | A | 4/2000 | Wong |
| 6,138,385 | A | 10/2000 | Jungkind et al. |
| 6,189,239 | B1 | 2/2001 | Gasparovic et al. |
| 6,279,251 | B1 | 8/2001 | Davis |
| 6,402,163 | B1 | 6/2002 | Pratt |
| 6,438,872 | B1 | 8/2002 | Chil et al. |
| 6,817,116 | B2 | 11/2004 | Chil et al. |

FOREIGN PATENT DOCUMENTS

| | | | |
|---|---|---|---|
| CA | 2201816 | A | 10/1998 |
| DE | 59317 | | 3/1891 |
| DE | 59 317 | C | 10/1891 |
| DE | 20205724 | | 7/2002 |
| EP | 1112698 | A | 7/2001 |
| EP | 1258268 | A | 11/2002 |
| FR | 27523369 | | 2/1998 |
| GB | 913182 | A | 12/1962 |
| WO | WO 92/18023 | | 10/1992 |
| WO | WO 92/28053 | | 9/1996 |
| WO | WO 01/33986 | | 5/2001 |

* cited by examiner

EXPANDABLE SHOE HAVING SCREW DRIVE ASSEMBLIES

CROSS REFERENCE TO RELATED APPLICATION

This application is a continuation-in-part of now U.S. patent application Ser. No. 10/191,682, filed Jul. 9, 2002, now U.S. Pat. No. 6,817,116 which is a divisional of U.S. patent application Ser. No. 09/438,935 filed on Nov. 12, 1999, which issued as U.S. Pat. No. 6,438,872 on Aug. 27, 2002, the contents of which are hereby incorporated by reference in their entirety.

BACKGROUND OF THE INVENTION

1. Technical Field

The present invention relates to expandable shoes that may be adjusted longitudinally.

2. Discussion of Related Art

Some attempts have been made to provide expandable shoes, which can purportedly withstand day-to-day use. U.S. Pat. No. 3,389,481, for example, discloses a shoe in which a two plate assembly is disposed between an inner and a disjointed outer sole, having overlapping front and back portions. One of the plates includes a spring tongue, and the other plate includes two apertures to receive the spring tongue, each aperture corresponding to a shoe size. To adjust the shoe size, a screw which extends through the heel and into the disjointed soles is removed. The shoe may then be pulled apart allowing the disjointed sole to separate until the spring tongue engages the next aperture. Thus the shoe size may be lengthened by one size, but apparently the size cannot be controlled finely or reduced. The shoe includes two crinkled leather portions 34, one on each side of the shoe, to facilitate expansion of the shoe.

SUMMARY

Under one aspect of the present invention, a shoe includes a front outer assembly and a rear outer assembly. A flexible, expandable segment is attached to the front and rear outer assemblies to define a shoe outer shell. The flexible segment extends at least partially along each side of the outer shell and transversely across the bottom of the outer shell. Within the outer shell an adjustable inner assembly is disposed and attached to the front and rear outer assembly. The inner assembly has a control to adjust a dimension of the inner assembly and thereby a corresponding dimension of the shoe.

Under another aspect of the invention related to the above aspect, the inner assembly may be in the form of a last board, or as a combination of a last board and other portions of the shoe, for example, a portion of a midsole.

Under one aspect of the invention, a visualization window provides a view port to the inner assembly. The inner assembly may include size markings or other indicia representative of a shoe adjustment, and these markings may be placed on the inner assembly to allow them to be visible through the view port.

Under another aspect of the invention, the inner assembly includes a first sole portion, a second sole portion, and a screw drive. The screw drive has an externally accessible screw passing through a screw insert mounted to one of the first and second sole portions and a screw-receiving portion attached to the other of the first and second sole portions. In this fashion, turning the screw causes the first and second portions to move relative to one another, thereby adjusting a dimension of the shoe.

Under still another aspect of the invention, the shoe includes a base and a manually operable control coupled to the base and to the screw for turning the screw and thereby adjusting adjust a dimension of the shoe.

Under another aspect of the invention, the control includes a latching mechanism operable between a first position in which the latching mechanism resists movement around an axis defined by the screw and a second position in which the latching mechanism can be used to turn the screw to adjust a dimension of the shoe. Under another aspect of the invention, a separate locking mechanism is used to hold the control in the first position.

Under another aspect of the invention related to the above, the control is externally accessible from the outer shoe and it is possible to adjust a dimension of the shoe while the shoe is being worn.

The principles of the invention may be realized in hiking shoes, dress shoes, sandals, skates, biking shoes, Nordic and cross-country ski-boots and the like.

DETAILED DESCRIPTION

Figure 1A:
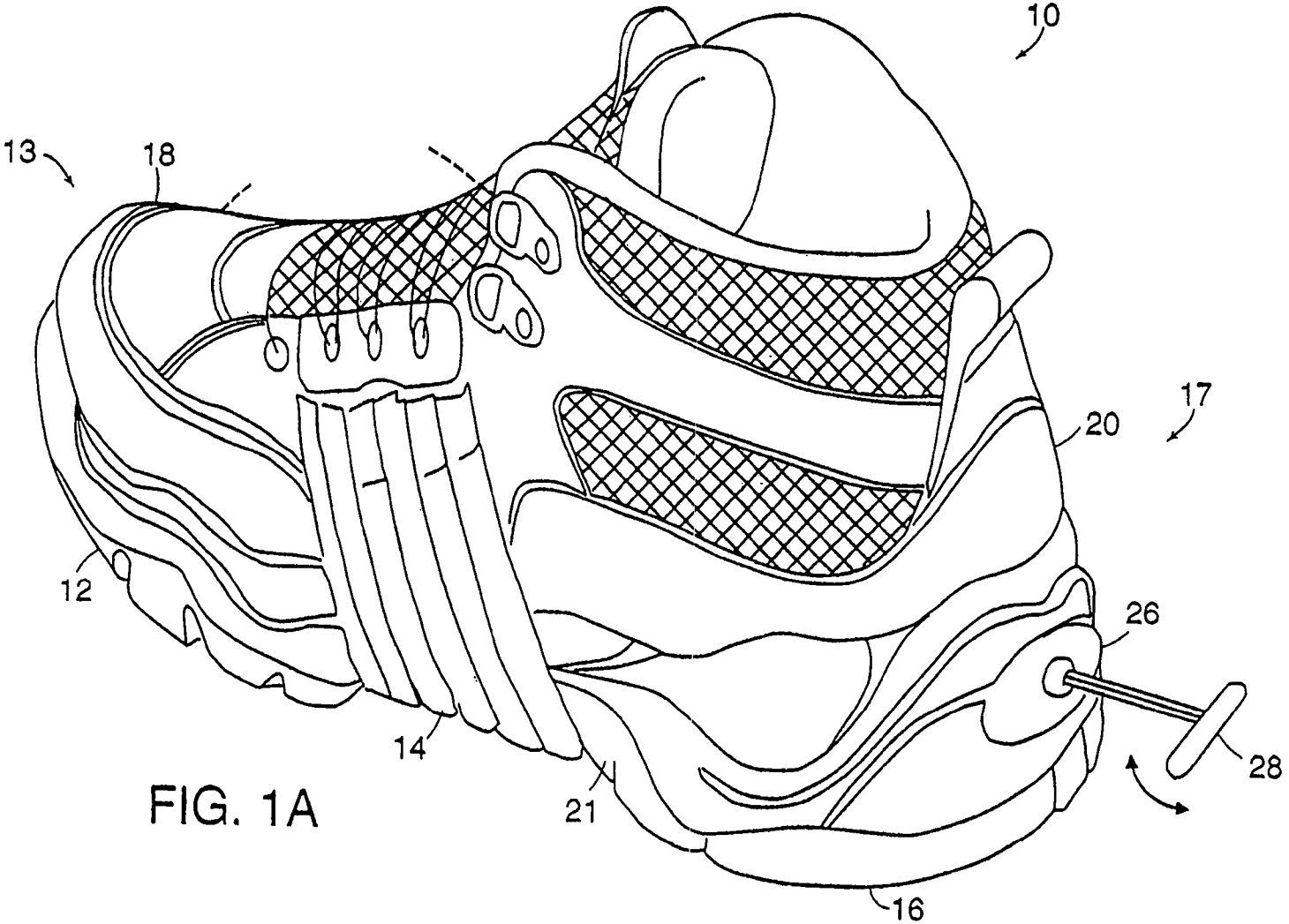
FIG. 1A is a perspective view of an exemplary embodiment of the invention.
Figure 1B:
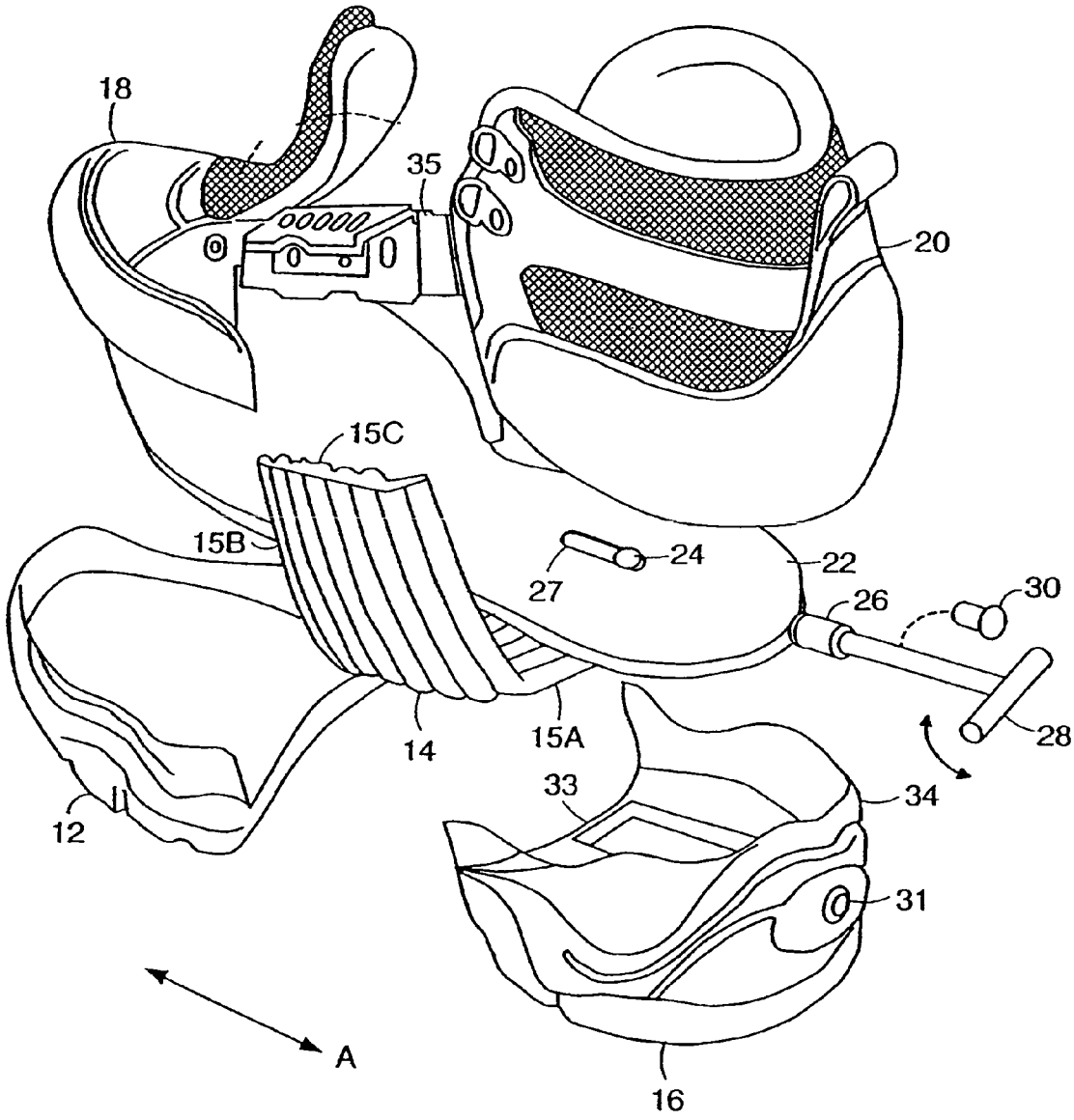
FIG. 1B is an exploded view of an exemplary embodiment of the invention.

FIGS. 1A-B show an exemplary embodiment in perspective and exploded views. Shoe 10 includes a front outer sole 12 and a front upper 18 to form a front outer assembly 13, and a rear outer sole 16 and a rear upper 20 to form a rear outer assembly 17. The front outer assembly 13 is attached to one edge 15B of a bellows segment 14, and the rear outer assembly 17 is attached to a second edge 15A, in each case using conventional techniques, such as by using stitching to the uppers 18, 20 and glue along the outer soles 12, 16. The combination of front outer assembly 13, rear outer assembly 17, and bellows segment 14 forms an outer shell 21.

An adjustable inner sole assembly 22 is placed within outer shell 21 so that a screw 26 extends through a screw port opening 31 of the rear outer sole 16. The inner assembly 22 is firmly attached to the front and rear outer assemblies 13, 17 but not to bellows 14. In this fashion, once the shoe is assembled and in use, a wrench 28 (e.g., with an allen-head design) may be used to turn a screw 26 to adjust the length of the inner sole assembly 22 (and correspondingly the entire shoe 10) in the direction A. A control feature 24 (more below) is positioned within guide slot 27 to facilitate the directional control of the shoe 10 as it is caused to expand or contract. Screw port plug 30 may be used to fit within screw port opening 31 to cover the screw 26 when the shoe is not being adjusted. To adjust the size of this embodiment, only the screw 26 needs to be turned. The size may be lengthened or shortened in fine increments corresponding to the pitch of the screw 26.

Figure 1C:
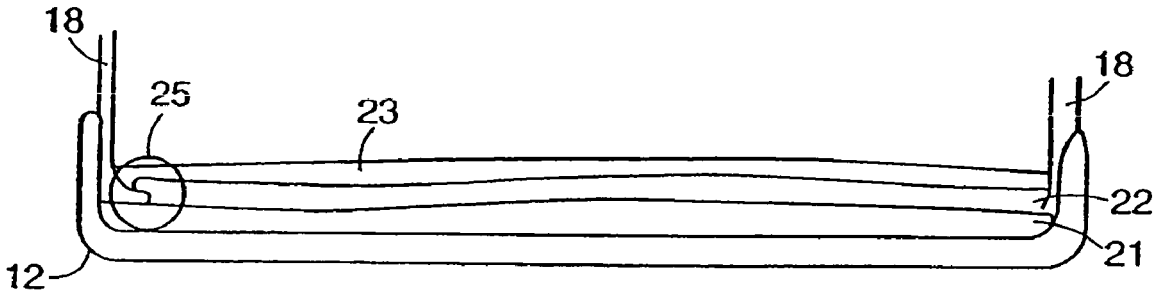
FIG. 1C is a transverse cross section of an exemplary embodiment of the invention.

FIG. 1C shows a transverse cross section of an assembled shoe. Not shown in FIGS. 1A-B, but shown here, are the inclusion of a midsole 21 and an inner sole 23. At area 25 the upper 18 is joined to the inner assembly 22 by glue or stitching. Analogous joinery may be used at a rear portion of the shoe. The inner sole 23 is conventional and the midsole may be conventional in embodiments using a last board or may be modified to form all or a portion of the inner assembly 22. This figure will illustrate to those skilled in the art, the simplicity of integrating the features of inner assembly 22 into the midsole or leaving it as a last board left in the shoe. Such integration is largely dictated by the type of shoe into which the principles of the invention will be realized, e.g., hiking shoes, dress shoes, biking shoes, ski boots, sandals and the like. Likewise, the stiffness of the last board and/or the midsole is dictated by the shoe type.

The front and rear outer soles 12, 16 may be made with conventional techniques and material to obtain popular shoe constructions. The front sole 12 may be made so that it is roughly only a front half of a shoe sole, and the rear outer sole 16 may be made so that it is only approximately a rear half of a sole. The rear outer sole, unlike conventional soles, is also made to define a screw port opening 31 and a generally rectangular recess 33 (see FIG. 1B) in the heel portion 34. (As will be described below, the recess 33 receives a portion of the inner sole assembly 22.) Analogously, the front and rear uppers 18, 20 may be made using conventional techniques and materials to obtain popular shoe appearances.

Bellows segment 14 is made of a stretchable material, e.g., rubbers, press coated fabrics, etc., and fashioned (e.g., molded or extruded) as a bellows in a generally rectangular segment, which is then shaped into the U-shape, extending along the sides and bottom of the shoe 10 as shown in FIG. 1B. The bellows segment 14 includes flat edges 15A, B opposite each other which is used in attaching the bellows 14 to the uppers 18, 20 and outer soles 12, 16. In the illustrated embodiment, edge 15C and a corresponding unshown edge opposite 15C are attached to expandable eyelet assemblies 35, described below.

Figure 2:
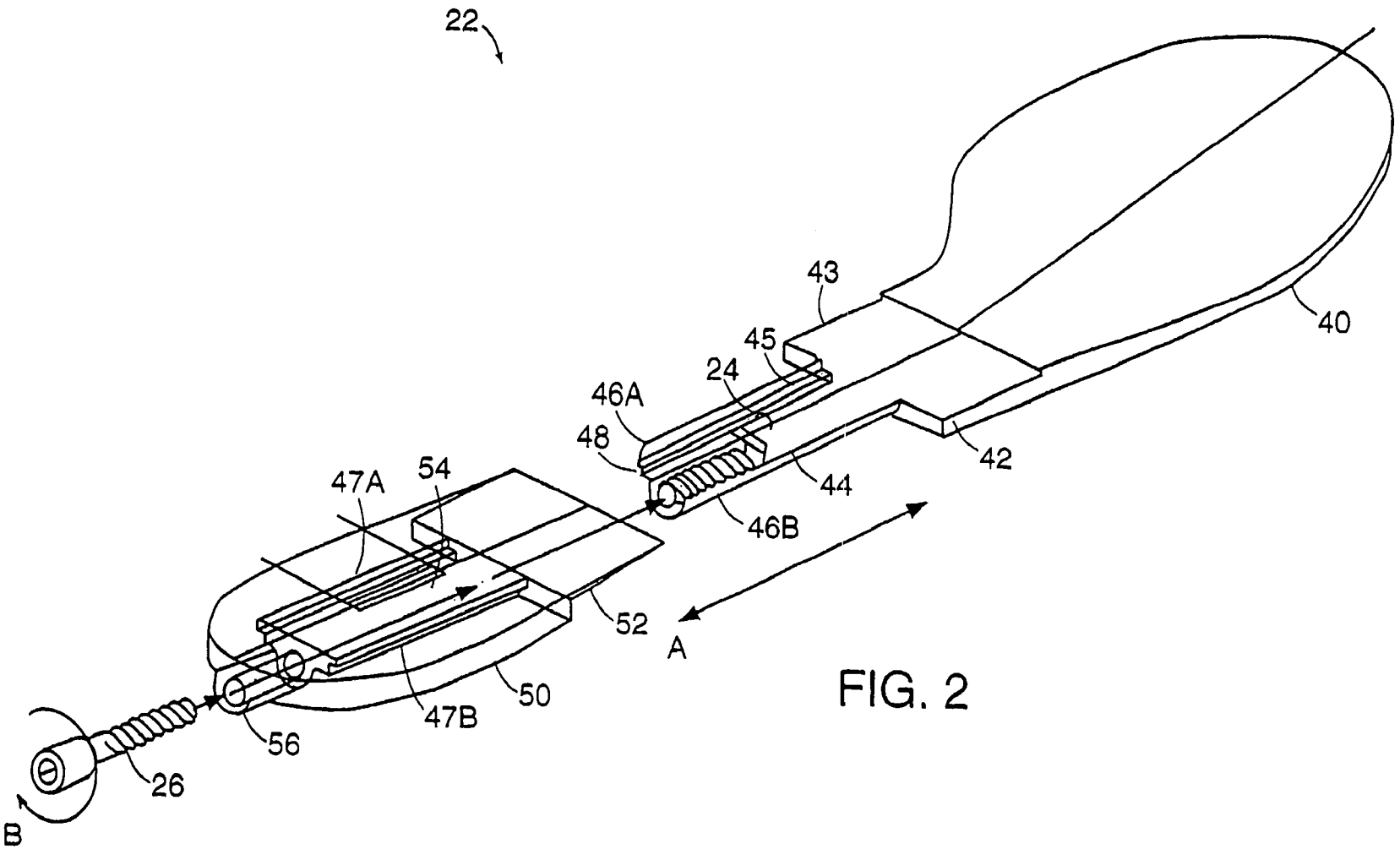
FIG. 2 is an exploded view of an adjustable inner sole assembly of an exemplary embodiment of the invention.

FIG. 2 shows an exploded view of adjustable inner assembly 22. The inner assembly 22 includes a front section 40 and a rear section 50. The top surface of each section is generally flat but may be shaped with slight curvature found in conventional designs. Viewing the sections 40, 50 from above, each section is cut according to a conventional inner sole pattern, except that each section respectively corresponds to approximately a front or rear half of an inner sole. Conventional materials may be used in fabricating the sections 40, 50, for example, through injection molding or analogous techniques.

A front adjustment member 42 may be attached to or integrated with front section 40. Front adjustment member 42 includes a generally flat section 43 and includes an elongated section 44 having a generally rectangularly shaped top portion 45 with wing-like extensions 46A and B. As will be explained below, wing-like extensions 46A and B are shaped to fit corresponding grooves 47A and B, within rear section 50. On the underside of elongated section 44 is a threaded screw-receiving section 48 that extends parallel to the longitudinal centerline of the front section 40, but which is offset from the top surface of front section 40. On the top side of the elongated section 44 is a control guide 24 protruding slightly upward and substantially on the longitudinal centerline of the front section 40. This guide 24 may be made in numerous ways, including for example, using rivets or integrating the shape into the design of member 42.

The rear section 50 is shaped on its underside to have a first hollowed segment 52 and a second hollow segment 54, more rearward than the first. The first segment 52 mates with flat section 43 of the front section 40, and the second segment 54 is shaped to receive the top portion 45 of the front section 40. Second hollow segment 54 includes longitudinal grooves 47A,B shaped to receive wing-like extensions 46A,B of front section 40. The rear section 50 also includes a screw section insert 56 for receiving and guiding screw 26 into alignment with screw-receiving section 48. The rear section 50 includes guide slot 27 along the longitudinal centerline of rear section 50 and through which the guide 24 is positioned once the inner assembly 22 is configured. As is readily apparent, for right-handed screws, once the screw 26 engages threads in hole 48, rotating screw 26 clockwise B will draw front section 40 closer to rear section 50, and vice-versa.

Figure 3:
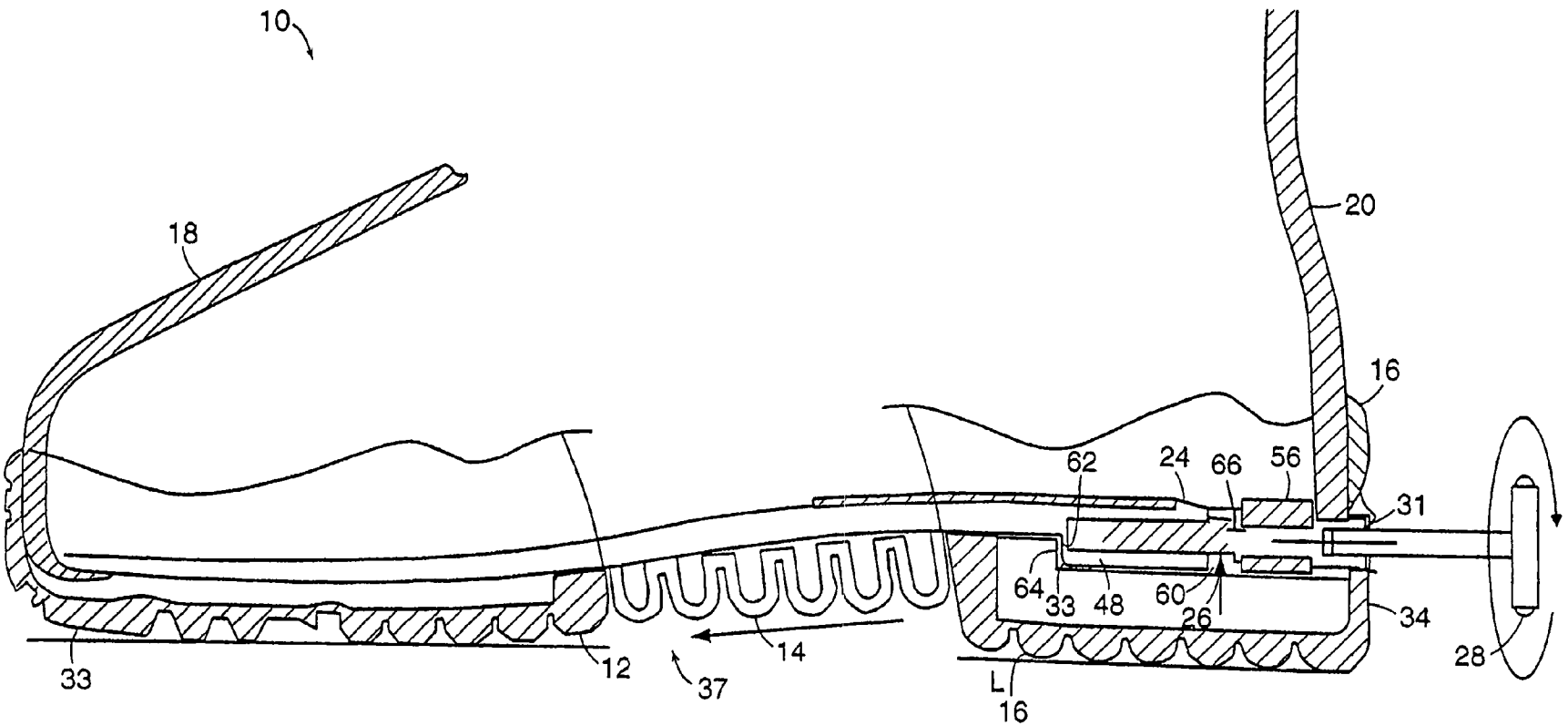
FIG. 3 is a cross-sectional view of an exemplary embodiment of the invention.

FIG. 3 is a cross-sectional, longitudinal view of shoe 10. For clarity of illustration, portions of the front section 40 and rear section 50 are not shown. As shown in FIG. 3, screw-receiving section 48 is positioned to fit within recess 33 of heel 34 of rear outer sole 16. The recess 33 has a longitudinal length sufficient to allow section 48 to be moved longitudinally therein, thus allowing for adjustment of the shoe. When the distal edge 60 of section 48 abuts insert 56, the shoe is at the smallest adjustment size. When the front edge 62 of section 48 abuts the front edge 64 of recess 33, the shoe is at its largest size. The size adjustments between smallest and largest are controlled by turning screw 26 and the granularity of the adjustment is only limited by the pitch of the screw 26. A clip 66 prevents screw 26 from becoming disengaged with section 48 and becoming dislodged from the shoe 10.

FIG. 3 also shows that the design of the soles 12, 16 may be made to provide a raised arch area 37 where the bellows segment 14 resides. The arch area is sufficiently raised from the wear surface 38 so that the exterior surface of the bellows segment 14 should not contact the ground. By having a raised area 37, the bellows 14 may be one continuous piece extending along the sides and bottom of the show, facilitating good sealing at the expandable portion of the outer shell 21.

FIGS. 4-7 show another embodiment of the invention, similar to that shown in FIGS. 1-3, but which includes a latching mechanism for manually turning the screw and thereby adjusting a dimension of the shoe.

Figure 5:
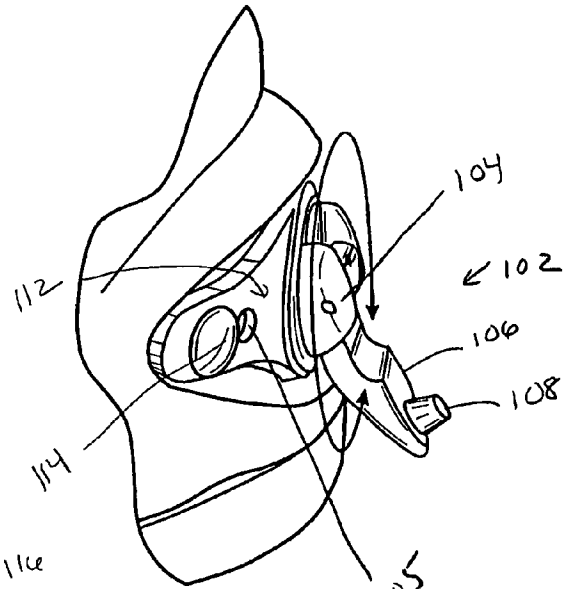
FIG. 5 is a perspective view of a control feature according to another embodiment of the invention.
Figure 4:
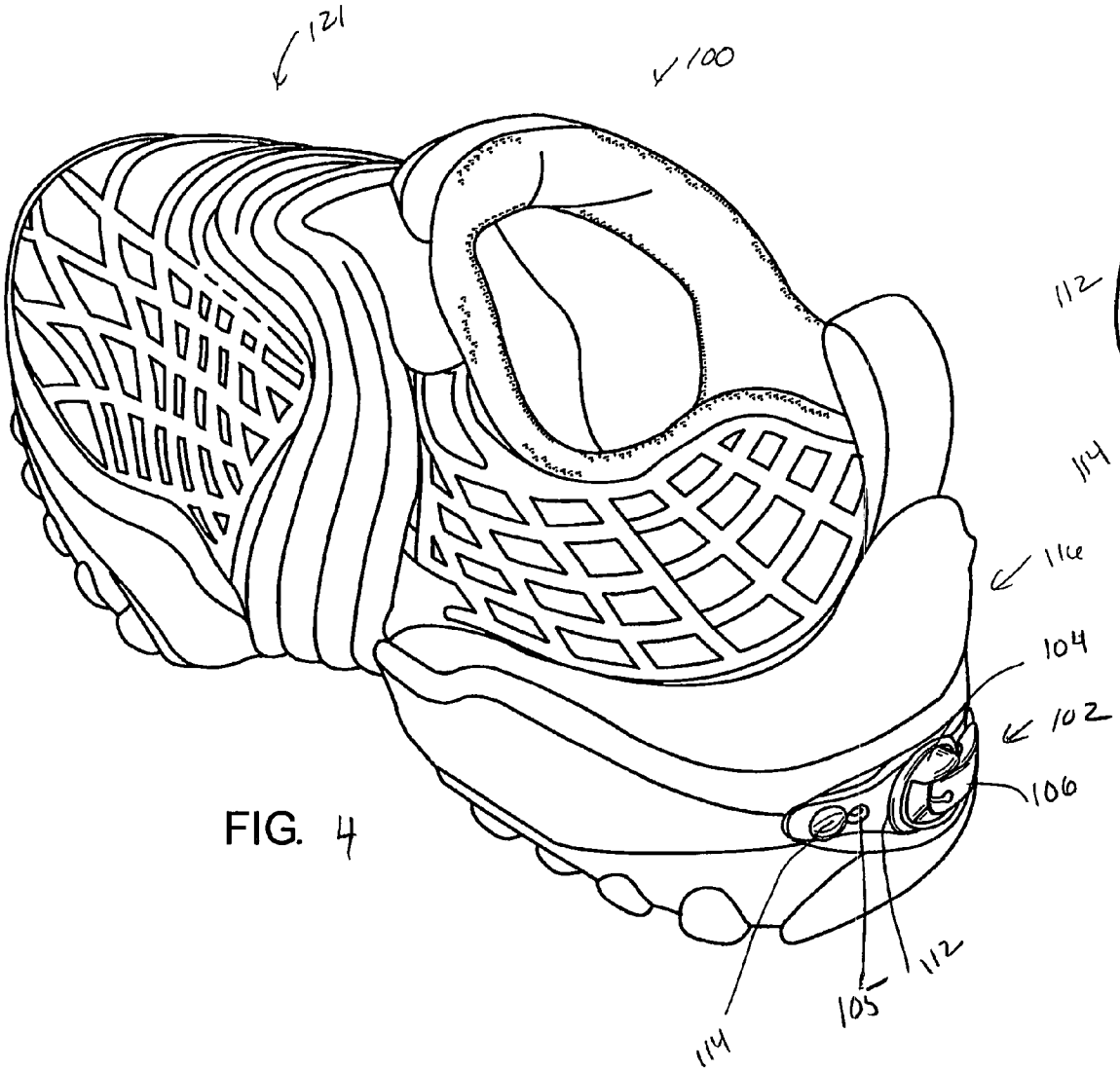
FIG. 4 is a perspective view of another embodiment of the invention.
Figure 6:
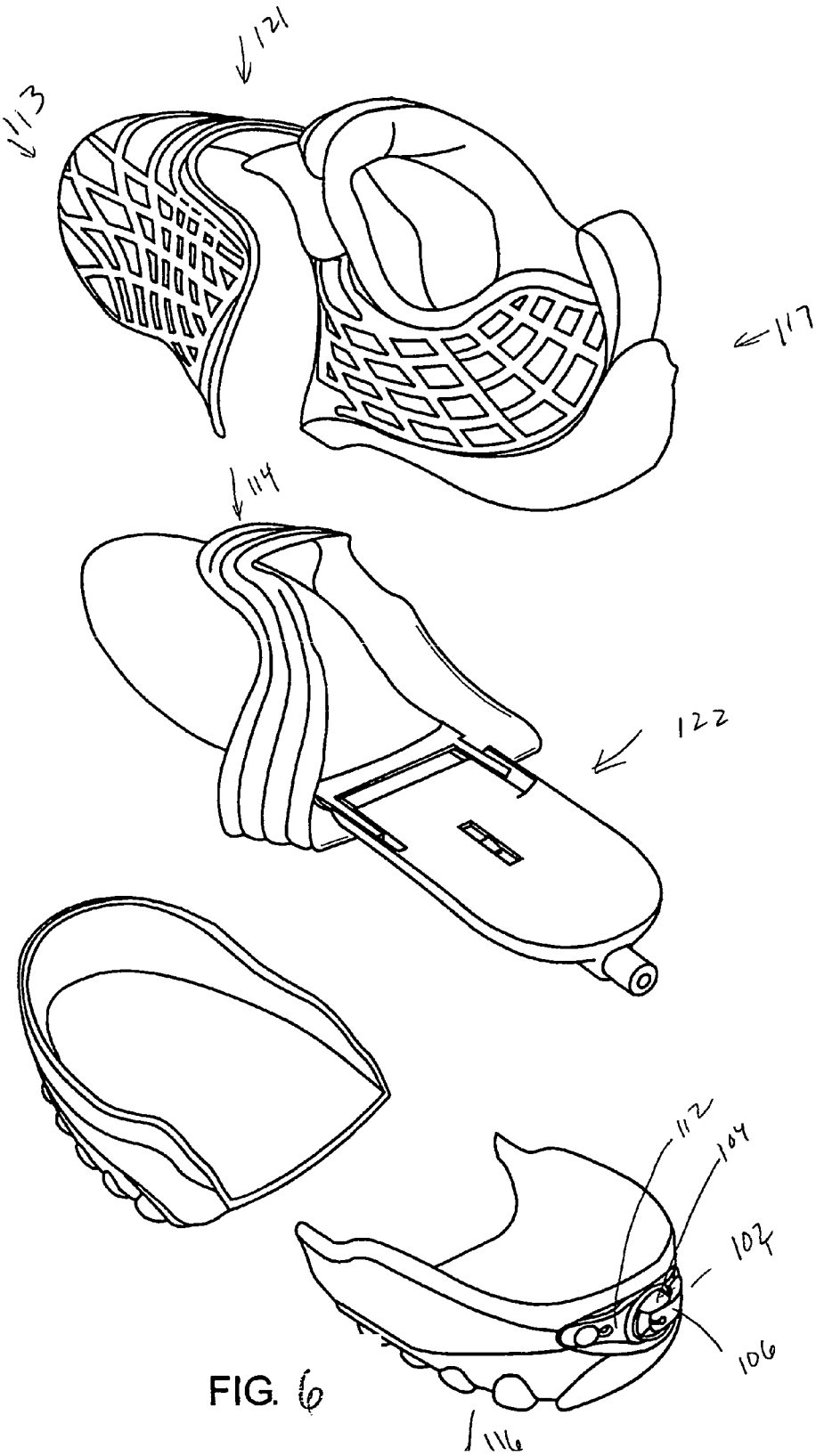
FIG. 6 is an exploded view of another embodiment of the invention.
Figure 7:
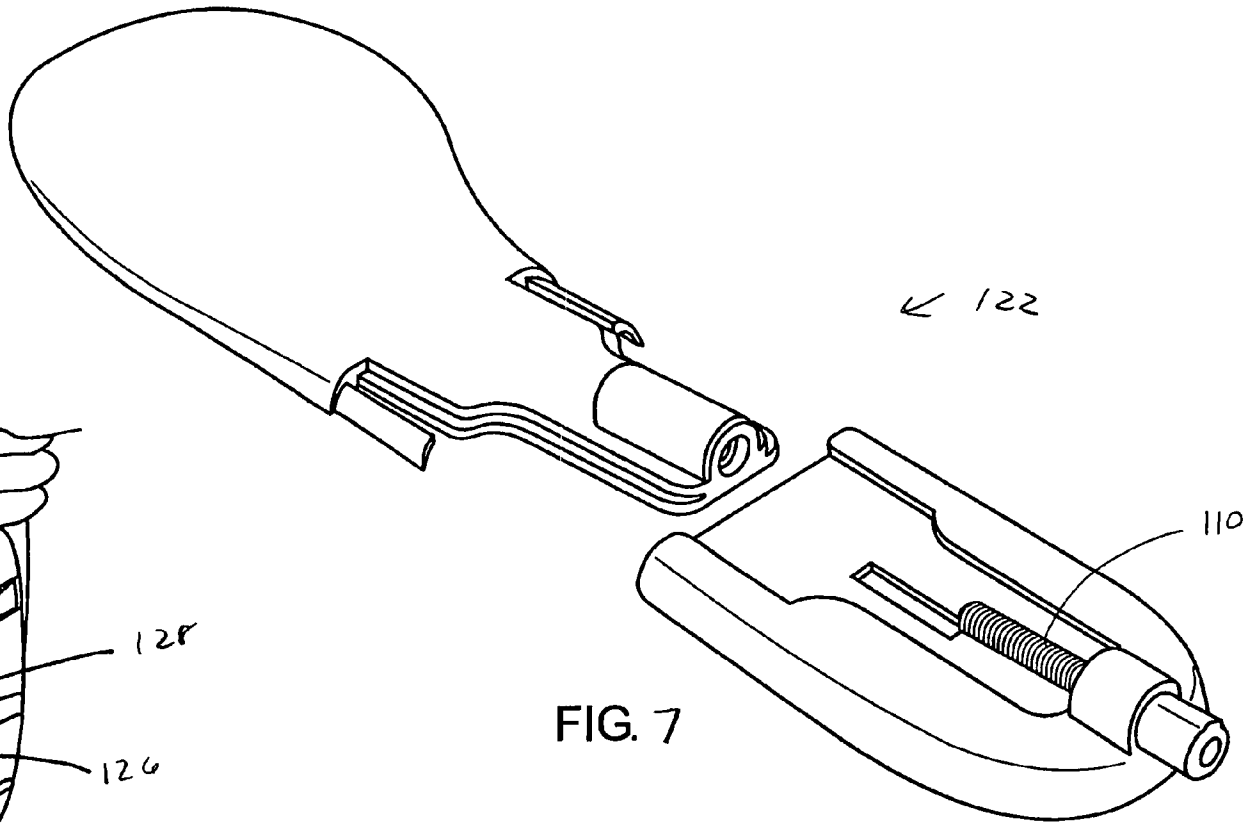
FIG. 7 is an exploded view of another embodiment of the invention.

FIGS. 6 and 7 show this embodiment in perspective and exploded views. An adjustable inner sole assembly 122 is placed within outer shell 121 so that a screw 110 extends through a screw port opening (not shown) of the rear outer sole 116. In the embodiment shown, a base 112 is attached to the outer heel portion 116 of the shoe surrounding the hole. The latching mechanism 102 is coupled to both the base 112 and to the screw 110. The base 112 is rigidly attached to an outer portion of the shoe and includes two cavities, one on each side of the base 112. FIGS. 4 and 5 show a cavity 105 on the left side of the shoe. An identical cavity on the right side of the shoe, is not shown. The latching mechanism 112 may be attached to the screw 110 or it may form an integral part of the screw itself.

The latching mechanism 102 is operable between a first position (shown in FIG. 4) in which the locking mechanism resists movement around an axis defined by the screw 110 and a second position (shown in FIG. 5) in which the latching mechanism 102 can be used to turn the screw 110 to adjust a dimension of the shoe.

As shown in FIG. 5, the latching mechanism 102 includes an extendable member 106, and a non-extendable member 104. The non-extendable member 104 is attached to the screw 110 and to the extendable member 106. A projection 108 is provided on the extendable member 106 and is accessible only when the latching mechanism 102 is in the open position. When the latching mechanism 102 is in the second position, the projection 108 rests in one of the cavities 105 in the base 112 to resist movement of the extendable member 106 and to prevent the dimension of the shoe from changing. In addition, the projection 108 can be manually grasped to make it easier to control the turn of the extendable member 106.

Figure 8:
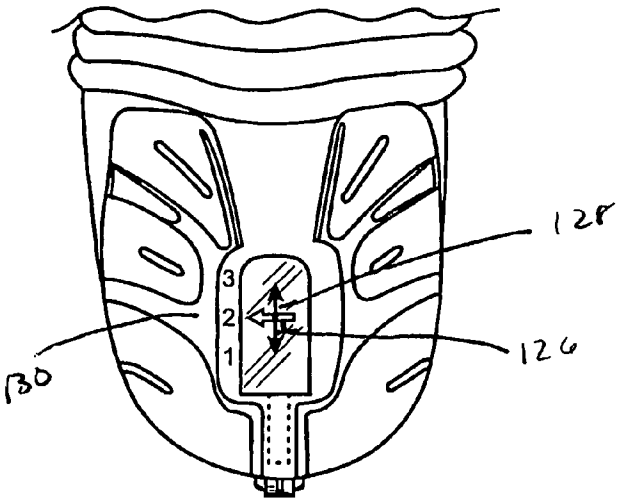
FIG. 8 is an exemplary embodiment of the invention in which view ports may be used to show indicia of a shoe adjustment.

FIG. 8 shows relevant portions of an exemplary embodiment having indicia 130 which can be marked with absolute or relative markings indicative of the adjustment that may be made. In the illustrated embodiment, the horizontal arrow 126 designates shoe size, while the vertical arrow 128 represents the direction that the horizontal arrow may move to indicate shoe size. A visualization window may be provided over the indicia.

Figure 9:
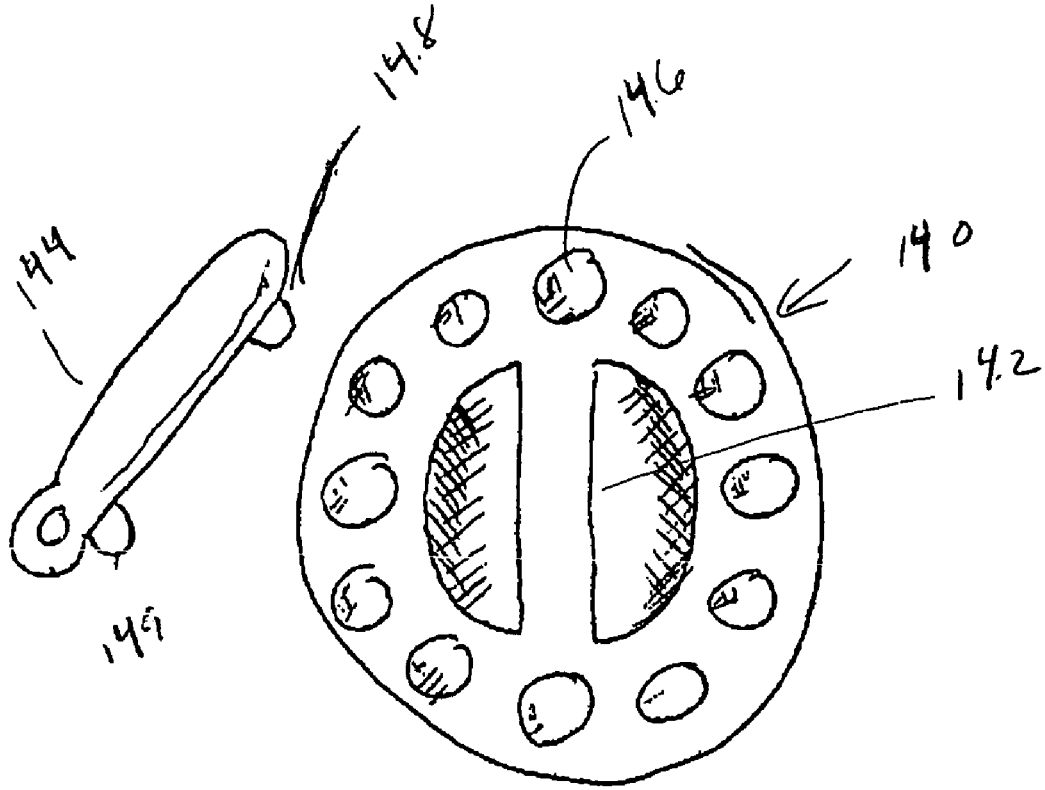
FIG. 9 is a view of another embodiment of the invention.

FIG. 9 shows another embodiment of a mechanism for manually turning the screw to adjust a dimension of the shoe. The mechanism includes a rotatable portion 140 that is attached to the shoe in the same way that the latching mechanism 102 is attached to the shoe (i.e., it is coupled to both the base 112 and to the screw 110). The base 112 can be a separate element that is rigidly attached to an outer portion of the shoe or it can be a part of the outer portion of the shoe itself (i.e., not a separate element to be attached). In addition, the rotatable member 140 may be attached to the screw 110 as a separate element or it may form an integral part of the screw itself.

The rotatable member 140 includes a member 142 that extends across a diameter of the rotatable portion 140 that can be manually grasped to turn the rotatable portion 140 and thereby turn the screw to adjust a dimension of the shoe. After the shoe is adjusted, a bar 144 is provided to cause the rotatable member 140 to resist movement around an axis defined by the screw 110. The bar 144 includes two projections, 148 and 149, each of which is inserted into a civility 146 in the rotatable member 140. When the projections 148 and 149 are in the cavities 146, the rotatable member 140 resists movement around an axis defined by the screw. When the bar 144 is removed from the cavities 146, the rotatable member 140 can be used to turn the screw.

In all of the embodiments described, the controls are easily accessible through the outer shell and not requiring access through the bottom portion of a sole. In some embodiments the adjustments may be made without any tools. All adjustments were relatively fine-grained, and size may be increased or decreased.

Preferred embodiments of the invention are described with particular reference to a hiking shoe design. Other embodiments entail other shoe constructions, including running shoes, biking shoes, ski boots, dress shoes, snow boarding boots, sandals, skates and the like. Depending on the shoe type, the inner assembly may be in the form of a last board, or a combination of a last board and a midsole. Likewise, depending on the shoe type, the materials used will be selected to provide a desired amount of flexibility or rigidity. Moreover, depending on the shoe design the outer shell may differ. In the case of a sandal, for example, one of the novel last boards may be used, but the outer shell would only have strapping. Other embodiments, such as a biking shoe, might have either netting, meshing, or no material where the bellows are shown, thus providing increased ventilation. In short, the outer shell design offers wide latitude though the bellows embodiments shown are believed novel and advantageous in some embodiments.

In other embodiments, the screw ports and conduits for rod members may be positioned in many other areas. Likewise, though the embodiments included the control mechanisms, such as the screws, screw receiving sections, gears and deformable teeth in a rear portion of the shoe, these features may be positioned at other portions as well.

Moreover, the above embodiments described a flexible segment made of a bellows-shaped material, but other embodiments may use other materials, e.g., stretchable nylon, netting or meshing, or it may be omitted. Likewise all of the control features described had external features to activate the control, but other embodiment (e.g., cost-reducing embodiments or embodiments where hiding the control is desirable) may place the control mechanisms on the interior of the outer shell.

While the invention has been described in connection with certain preferred embodiments, it will be understood that it is not intended to limit the invention to those particular embodiments. On the contrary, it is intended to cover all alternatives, modifications and equivalents as may be included in the appended claims. Some specific components, figures and types of materials are mentioned, but it is to be understood that such component values, dimensions and types of materials are, however, given as examples only and are not intended to limit the scope of this invention in any manner.

What is claimed is:

1. Footwear, comprising:

an outer shell including an outer sole, the outer shell configured with materials having a degree of flexibility that allows a ball of a foot of a user to flex when walking and the outer sole to flex about the ball of the user's foot when the user is walking;

a screw drive assembly disposed within the outer shell, the screw drive assembly including a first member, a second member, and a screw in operative engagement with the first and second members so that turning the screw causes the first and second members to move relative to one another thereby causing a dimension of the footwear to change; and a control coupled to the screw for turning the screw and thereby adjusting a dimension of the footwear by adjusting the position of the first member relative to the second member, wherein the control requires only manual, toolless operation to adjust a dimension of the footwear and wherein the control remains coupled to the screw when a user is walking in the footwear, wherein the first member and second member are in overlapping engagement with each other and wherein the first and second members are shaped such that they are slidable relative to each other longitudinally and wherein the first member includes an extension shaped to fit within a corresponding portion of the second member and wherein at least one of the first and second members are configured with materials having a degree of flexibility that allows the at least one of the first and second members to flex when the user is walking.

2. The footwear of claim 1 wherein the control is externally accessible from the outer shell.

3. The footwear of claim 1 further comprising an indicator bearing indicia of the adjustable dimension of the footwear, the indicator including a marker to point to the applicable indicia, wherein at least one of the indicia and the marker are located on at least one of the first member and the second member such that the at least one of the indicia and the marker is viewable through the outer sole.

4. The footwear of claim 1, wherein the outer shell also includes a flexible, expandable segment.

5. The footwear of claim 4, wherein the outer shell further includes a front outer assembly attached to a first edge of the flexible, expandable segment and a rear outer assembly attached to a second edge of the flexible, expandable segment such that the flexible, expandable segment is between the front outer assembly and the rear outer assembly.

6. Footwear, comprising:

an outer shell including a front outer assembly attached to an edge of a bellows segment and a rear outer assembly attached to a second edge of the bellows segment, the outer shell including an outer sole, the outer shell configured with materials having a degree of flexibility that allows a ball of a foot of a user to flex when walking;

a screw drive assembly disposed within the outer shell, the screw drive assembly including a first member, a second member, and a screw in operative engagement with the first and second members so that turning the screw causes the first and second members to move relative to one another; and a control coupled to the screw for turning the screw and causing the first and second members to move relative to one another, thereby adjusting a dimension of the footwear, wherein the control remains coupled to the screw when a user is walking in the footwear, wherein the first member and second member are in overlapping engagement with each other and wherein the first member includes an extension shaped to fit within a corresponding portion of the second member.

7. The footwear of claim 6 wherein the control requires only manual, tool-less operation to adjust a dimension of the footwear.

8. The footwear of claim 6, wherein the front outer assembly includes a front outer sole and a front upper and wherein the rear outer assembly includes a rear outer sole and a rear upper.

9. The footwear of claim 6, further comprising a base, wherein the screw passes;

through the base; and wherein the control is operable between a first position in which the control resists movement around an axis defined by the screw and a second position in which the control can be used to turn the screw to adjust a dimension of the footwear.

10. The footwear of claim 9 wherein the control is manually operable to turn the screw and thereby adjust a dimension of the footwear.

11. The footwear of claim 9 wherein the base is rigidly attached to the rear outer assembly.

12. The footwear of claim 9 wherein the base is an integral part of the rear outer assembly.

13. The footwear of claim 9 wherein the control includes a protrusion, accessible when the control is in the second position, for manually operating the control to turn the screw and thereby adjust a dimension of the adjustable assembly.

14. The footwear of claim 9 further comprising a locking mechanism to hold the control in the first position.

15. Footwear comprising:

an outer shell including an outer sole, the outer shell configured with materials having a degree of flexibility that allows a ball of a foot of a user to flex when walking and the outer sole to flex about the ball of the user's foot when the user is walking;

a base;

a screw drive assembly disposed within the outer shell, the screw drive assembly including a first member, a second member, and a screw passing through the base and in operative engagement with the first and second members so that turning the screw causes the first and second members to move relative to one another thereby causing a dimension of the footwear to change; and a latching mechanism, coupled to the base and to the screw drive assembly, and operable between a first position in which the latching mechanism resists movement around an axis defined by the screw and a second position in which the latching mechanism can be used to turn the screw to adjust a dimension of the footwear by adjusting the position of the first member relative to the second member, wherein the first member and the second member are in overlapping engagement with each other and wherein the first member includes an extension shaped to fit within a corresponding portion of the second member and wherein at least one of the first and second members are configured with materials having a degree of flexibility that allows the at least one of the first and second members to flex when the user is walking.

16. The footwear of claim 15 wherein the latching mechanism includes a protrusion and the base includes a cavity adapted to receive the protrusion when the latching mechanism is in the first position.

17. The footwear of claim 15, wherein the outer shell also includes a flexible, expandable segment.

18. The footwear of claim 17, wherein the outer shell further includes a front outer assembly attached to a first edge of the flexible, expandable segment and a rear outer assembly attached to a second edge of the flexible, expandable segment such that the flexible, expandable segment is between the front outer assembly and the rear outer assembly.

19. An adjustable assembly for footwear, comprising:

a screw drive assembly including a first member, a second member, and a screw in operative engagement with the first member and the second member so that turning the screw causes the first and second members to move relative to one another;

a control coupled to the screw for turning the screw and causing the first and second members to move relative to one another, thereby adjusting a dimension of the footwear, wherein the control remains coupled to the screw when a user is walking in footwear including the adjustable assembly; and an indicator bearing indicia of the adjustable dimension of the footwear, the indicator including a marker to point to the applicable indicia, wherein the first member and the second member are in overlapping engagement with each other and wherein the first member includes an extension shaped to fit within a corresponding portion of the second member and wherein at least one of the first and second members are configured with materials having a degree of flexibility that allows the at least one of the first and second members to flex when the user is walking in footwear including the adjustable assembly.

20. The adjustable assembly of claim 19 wherein the control requires only manual, tool-less operation to adjust a dimension of the footwear.

21. An adjustable assembly for footwear comprising a screw drive assembly including a first member, a second member, a base, and a screw passing through the base, the screw in operative engagement with the first and second members so that turning the screw causes the first and second members to move relative to one another thereby causing a dimension of the footwear to change;

a control coupled to the screw, operable between a first position in which the control resists movement around an axis defined by the screw and a second position in which the control can be used to turn the screw to adjust a dimension of the adjustable assembly, wherein the control remains coupled to the screw when a user is walking in footwear including the adjustable assembly; and an indicator bearing indicia of the adjustable dimension of the footwear, the indicator including a marker to point to the applicable indicia, wherein the first member and the second member are in overlapping engagement with each other and wherein the first member includes an extension shaped to fit within a corresponding portion of the second member and wherein at least one of the first and second members are configured with materials having a degree of flexibility that allows the at least one of the first and second members to flex when the user is walking in footwear including the adjustable assembly.

22. The adjustable assembly of claim 21 wherein the control is rotatable around an axis of the screw when the control is in the second position.

* * * * *

UNITED STATES PATENT AND TRADEMARK OFFICE

CERTIFICATE OF CORRECTION

PATENT NO. : 7,581,337 B2
APPLICATION NO. : 10/875973
DATED : September 1, 2009
INVENTOR(S) : Miller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 476 days.

Signed and Sealed this

Fourteenth Day of September, 2010

David J. Kappos

David J. Kappos
*Director of the United States Patent and Trademark Office*